US012320082B2

(12) United States Patent
Petters

(10) Patent No.: US 12,320,082 B2
(45) Date of Patent: Jun. 3, 2025

(54) APPARATUS AND METHOD FOR INSTALLATION OF SUPPORT POSTS FOR A VEHICLE RESTRAINT SYSTEM

(71) Applicant: Karl Petters, Newmarket (GB)

(72) Inventor: Karl Petters, Newmarket (GB)

( * ) Notice: Subject to any disclaimer, the term of this patent is extended or adjusted under 35 U.S.C. 154(b) by 298 days.

(21) Appl. No.: 17/436,887

(22) PCT Filed: Mar. 11, 2020

(86) PCT No.: PCT/GB2020/050580

§ 371 (c)(1),
(2) Date: Sep. 7, 2021

(87) PCT Pub. No.: WO2020/183153

PCT Pub. Date: Sep. 17, 2020

(65) Prior Publication Data

US 2022/0162819 A1 May 26, 2022

(30) Foreign Application Priority Data

| | | |
|---|---|---|
| Mar. 13, 2019 | (GB) | 1903442 |
| Oct. 23, 2019 | (GB) | 1915350 |
| Jan. 7, 2020 | (GB) | 2000170 |
| Jan. 21, 2020 | (GB) | 2000852 |

(51) Int. Cl.
*E01F 15/04* (2006.01)

(52) U.S. Cl.
CPC ..... *E01F 15/0476* (2013.01); *E01F 15/0484* (2013.01)

(58) Field of Classification Search
CPC ... E01F 15/04; E01F 15/0407; E01F 15/0415; E01F 15/0461; E01F 15/0469; E01F 15/0476; E01F 15/0484; E01F 15/0492
See application file for complete search history.

(56) References Cited

U.S. PATENT DOCUMENTS 5,123,773 A * 6/1992 Yodock ..... E01F 15/088 404/6
5,156,485 A * 10/1992 Ivey ..... E01F 15/088 404/6
5,186,438 A * 2/1993 Cross ..... E01F 9/669 403/294

(Continued)

FOREIGN PATENT DOCUMENTS

CN 104005352 A 8/2014
DE 2111953 A1 * 3/1972 ..... H02G 9/065

(Continued)

OTHER PUBLICATIONS

Translated publication of JP 2004084184 A. Ando, Kauhiko. Precast Continuous Footing for Guardfence. Mar. 18, 2004.*

*Primary Examiner* — Amber R Anderson
*Assistant Examiner* — Kevin J Baynes
(74) *Attorney, Agent, or Firm* — SZDC Law PC

(57) ABSTRACT

Disclosed is an apparatus for installing a vehicle restraint at a desired location, the apparatus comprising a length of a pre-fabricated base unit locatable in or on the ground at the desired location, the base unit having a plurality of attachment positions at intervals for attachment thereto of at least one substantially vertical support post for supporting the vehicle restraint.

22 Claims, 13 Drawing Sheets

(56) References Cited

U.S. PATENT DOCUMENTS

| | | | | | |
|---|---|---|---|---|---|
| 5,471,811 | A * | 12/1995 | House | E01F 15/083 | 52/745.1 |
| 5,664,905 | A * | 9/1997 | Thompson | E01D 19/103 | 248/548 |
| 6,413,009 | B1 * | 7/2002 | Duckett | E01F 15/083 | 404/6 |
| 7,537,411 | B2 * | 5/2009 | Yodock, Jr. | E01F 15/088 | 404/9 |
| 8,277,143 | B2 * | 10/2012 | Adler | E01F 13/12 | 404/9 |
| 10,837,150 | B2 * | 11/2020 | Muegerl | E01F 15/088 | |
| 2004/0076468 | A1 * | 4/2004 | Mckay | E01F 15/088 | 404/6 |
| 2022/0056654 | A1 * | 2/2022 | Rico Arenal | E01F 15/088 | |

FOREIGN PATENT DOCUMENTS

| | | | | |
|---|---|---|---|---|
| JP | 2004084184 | A | 3/2004 | |
| WO | WO-9514822 | A1 * | 6/1995 | E01F 15/0476 |
| WO | 2010132616 | A1 | 11/2010 | |
| WO | 2015033100 | A1 | 3/2015 | |

* cited by examiner

APPARATUS AND METHOD FOR INSTALLATION OF SUPPORT POSTS FOR A VEHICLE RESTRAINT SYSTEM

This application is the National Stage Application of PCT/GB2020/050580, filed on Mar. 11, 2020, which claims priority to Great Britain Patent Application Nos. GB 1903442.0, filed on Mar. 13, 2019; GB 1915350.1, filed on Oct. 23, 2019; GB 2000170.7, filed on Jan. 7, 2020; and GB 2000852.0, filed on Jan. 21, 2020, all of which are incorporated by reference for all purposes as if fully set forth herein.

FIELD OF THE INVENTION

The present invention relates to a novel apparatus and system for installing support posts for a vehicle restraint system, and to a system for and method of installing a vehicle restraint system.

BACKGROUND OF THE INVENTION

It has been known for many decades to install crash barriers (now known as "vehicle restraint" systems) along the outer edge of motorway carriageways and along the central reservation. Such vehicle restraint systems are also used on many non-motorway routes.

Methods and systems for installing a crash barrier should be distinguished from methods and systems for installing bollards, as the requirements and features of the two are very different. With a crash barrier system, the horizontal barrier (a substantially continuous metal rail or wire) is mounted on or attached to uprights—the spacing between the uprights is too great to be sure that they will prevent a typical vehicle (such as an average size saloon car) passing between them. Thus the presence of the horizontal barrier is essential to the efficacy of the system. In contrast, bollard systems comprise discrete individual bollards mounted close together with an interval or spacing between them which is too small to permit the passage of a typical vehicle. Thus, with bollard systems, typically just one or at most two will be impacted by the collision of a single vehicle and thus the bollards themselves must be robustly constructed, and firmly anchored, to resist the forces of an impact. With a crash barrier, the horizontal barrier itself serves to dissipate the force of an impact to a large extent, and typically to spread the force of the impact among two or more uprights. As a result the upright support posts can be much less robustly constructed than bollards. In addition, bollards are typically used in comparatively small installations (perhaps up to a few tens of metres) whilst crash barrier systems may run for tens of kilometres—thus the cost considerations in each instance are very different.

There are many different crash barrier systems in use, which differ to some extent in design and dimensions, but they are all generally similar and intended to prevent vehicles from crossing from one carriageway to the other, or to prevent vehicles from colliding with, or entering, roadside hazards.

The crash barrier itself is normally a substantially horizontal steel member, attached to a plurality of vertical steel support posts which are positioned at intervals. Each support post must be stably anchored, in order to resist impact in the event of a vehicle crashing into the crash barrier.

Currently there are three ways most commonly used in the UK to anchor crash barrier support posts. These are: (i) "driven post"; (ii) "excavated foundation"; and (iii) "surface-mounted post".

In the 'driven post' technique, the support post is simply driven into the ground, typically to a depth of 1 to 1.5 metres. This technique is cheap and easy and probably that which is most often employed. However, it requires that the ground is soft enough to drive in the post but hard enough to provide adequate support, and that there are no services (e.g. electric cables, drains, sewers, gas or water pipes) or other obstacles buried beneath the relevant location. If the driven post technique is not suitable, one of the other methods must be used. In particular, these do not require penetration into the ground to such a great depth. In the "excavated foundation" technique, a hole (of variable size) is dug, and the support post embedded in a concrete foundation formed in the excavated hole (with or without a metal socket therein to accommodate the post). The excavated hole is usually at least 600 mm deep and typically 800-1000 mm deep to accommodate a support post and anchor it adequately. In other circumstances it may be necessary to use a surface-mounted post. Typically, in this method, the support post is welded to a steel cradle, which in turn is bolted to holes in a concrete surface, the holes being filled with a synthetic resin which cures to firmly anchor the cradle and attached post to the surface.

Whatever technique is used to anchor the support post, the 'strength' of anchoring must pass the associated "push test"—there are principally two tests, using a force of either 6 kiloNewtons or 9 kiloNewtons applied to the post (laterally, in the same direction that a vehicle would impact the post). The amount of 'give' in the post must be less than a particular threshold.

The various methods of anchoring posts all suffer from a variety of disadvantages. One very significant disadvantage is a lack of certainty regarding the suitability of a particular post-anchoring technique for a particular location, which makes planning very difficult. In particular because the characteristics of the ground, in which the posts are to be anchored, cannot be predicted in advance, and will tend to vary along the length of a road construction project, it is not possible to predict what type of anchor, (and, for example, what size of excavation) will be required to meet the push test criteria, without a needless over-specification of the anchor, which of course adds unnecessarily to the cost of the project.

Another disadvantage may often be a lack of "serviceability". If a post is damaged in a collision, it can often be quite difficult to replace it, and repairs are thus quite complex.

A further problem is that the speed of installation of the posts (especially if using a technique other than the "driven post") can be rather slow.

The present invention aims to provide apparatus, a system, and a method for installing support posts for a vehicle restraint system which overcome these problems and which, in preferred embodiments, further contribute a plurality of significant benefits.

SUMMARY OF THE INVENTION

In a first aspect the invention provides apparatus for installing a vehicle restraint at a desired location, the apparatus comprising a length of a pre-fabricated base unit locatable in or on the ground at the desired location, the base unit having a plurality of attachment positions at intervals for attachment thereto of at least one substantially vertical support post for supporting the vehicle restraint.

Desirably the base unit consists, or is predominantly formed of, concrete. The concrete may optionally comprise metal reinforcement. Preferred metal (e.g. steel) reinforcement will comprise a plurality of metal rods running along the long axis of the base unit. If desired, one or more further transverse metal reinforcement rods may be provided, substantially at a right angle to the long axis of the base unit.

In typical embodiments the base unit will comprise a substantially rectilinear shape, similar to a concrete beam. It will be apparent that the base unit is advantageously provided in modular sections. Each modular section of base unit will normally be essentially identical and, in practice, a plurality of such modules will be laid end to end to achieve the desired length of run of base unit. The precise dimensions of the base unit modules are not critical, but a typical embodiment of the invention may be 6 to 8 metres in length, about 800 to 1200 mm wide and 200 to 400 mm in height.

The base unit will, in use, generally be located in a shallow trench. The depth of the trench will advantageously be less than the depth reached by the bottom of a support post driven into the ground in the "driven post" technique, and will be less than the depth of excavation normally required for the "excavated foundation" technique. Conveniently the trench will be 150-250 mm deep, preferably about 200 mm deep. In this way, a benefit of the invention is that such a relatively shallow trench is less likely to impact on buried services, and the person skilled in the art will have more freedom in deciding where to position the vehicle restraint system. The strength and inertia of the base unit is such that a relatively shallow trench is sufficient to provide adequate anchorage. Indeed, in extremis (and typically only for temporary installations) it may be possible for the base unit to be used above ground, without any trench.

It is highly preferred that the base unit is perforated or apertured, for reasons explained below.

There is a considerable variety of commercially available vehicle restraint systems, and these will typically dictate the interval between attachment positions on the base unit. For example, one system in widespread use has support posts located 1600 or 3200 mm apart, depending on the rigidity required in the system, whilst another commonly-used system has support posts at intervals of 2000 mm; and the interval between attachment positions on the base unit of the invention may preferably correspond to one of these commonly-used distances, but other embodiments with different intervals, for use with other vehicle restraint systems, are perfectly feasible and envisaged in the present invention.

In a preferred embodiment, the base unit resembles a ladder, with transverse portions or "rungs" at regular fixed intervals across the base unit where the attachment positions are provided. The base unit between the rungs is apertured or perforated, typically with one aperture or perforation between each pair of adjacent "rungs". The apertures or perforations are conveniently positioned along the centre line of the base unit. Advantageously the apertures or perforations extend over more than half of the separation between adjacent attachment positions.

One purpose of the apertures or perforations in the base unit is to facilitate access to any services which might be located beneath the base unit, thereby fairly readily permitting inspection, maintenance or repair of the services as required. The apertures are thus desirably of sufficient dimension to permit such access. Another purpose of the apertures or perforations is to facilitate drainage of rain water and the like. In order to facilitate access to underlying services, it is highly preferred that any metal reinforcing components present in the base unit do not extend into the apertures or perforations. For this reason, the use of reinforcing mesh or grids is preferably avoided, and instead reinforcing bars or rods, which can be offset beyond the side of the apertured portions of the base unit, are advantageous.

However, it may be preferable that some or all of the apertures are provided with a mesh, typically made of steel, which is removably located within the apertures. Such mesh is to be distinguished from the structural reinforcing elements which are embedded within the concrete of the base unit and cannot be removed therefrom. The purpose of the removable mesh is to permit the passage of rainwater or other fluids through the apertures, whilst preventing the ingress of soil, leaves or the like. Water or other fluid passing through the apertures may enter a drainage channel provided in an optional conduit unit described below. The removable mesh may be secured within the apertures by releasable attachment means, such as screws, clips or the like. The mesh may be removed to facilitate access to services located beneath the base unit.

The exact type of attachment position provided on the base unit is not critical to the present invention, and several different designs of attachment position can be envisaged. The attachment positions on the base unit are desirably predetermined, and conveniently are at a fixed, and preferably regular, interval along the base unit. It is a highly preferred feature of the invention that the support post, once attached to the base unit, is sufficiently firmly anchored that it will be guaranteed to meet the 6 kiloNewton or 9 kiloNewton push test, as appropriate. The inventor had found that, in tests, the support post will typically deform rather than the base unit moving.

In this way, using the pre-fabricated base unit of the invention, a planner planning the construction of a road can know in advance, with certainty, that the specified support posts for a vehicle restraint system will, when in position, pass the appropriate anchor push test. Further, it avoids any need to test the conditions of the ground along the edge of the carriageway to ascertain what type of post anchor would be suitable.

In order to provide the necessary anchoring capability for the support posts, the base unit of the invention can readily be designed with sufficient rigidity and mass/inertia. The requirements for these parameters will depend on the manner in which the pre-fabricated base unit is to be used, and the location of its deployment. It is envisaged therefore that, in practice, a range of pre-fabricated base units may be produced with different dimensions and mass, such that a skilled person planning a road construction can select those pre-fabricated base units which are most appropriate for the particular construction. Thus, for example, bigger and more massive pre-fabricated base units may be appropriate if the base units are to be surface-exposed and/or used on ground of relatively low resistance; whilst smaller and less massive pre-fabricated base units may be appropriate for situations in which the base unit will be sited within a trench which is back-filled to a significant extent.

Other advantages stemming from the invention may include:

(a) increased speed of installation—the base units can be rapidly installed, there is no need to conduct ground testing, and generally less need to perform any excavation by hand (which slows down the rate of construction);

(b) increased flexibility—as the base unit does not need to be positioned as deep as driven posts, there is less risk of damage to underlying services during installation of the vehicle restraint system, and less likelihood of underground obstructions interfering with the preferred siting of the support posts;

(c) increased reliability—the support post positions are predetermined by the attachment positions on the base unit, leaving less chance of error by workmen on site;

(d) reusability—the base unit can be easily dug up and re-used e.g. if utilized on a temporary construction site or if a carriageway is re-routed, and especially in view of the modular nature of the base unit, one or more sections of base unit can be easily replaced (e.g. if damaged);

(e) increased ease of access to services located beneath the vehicle restraint system, due to the perforated or aperture nature of the preferred base unit;

(f) reduced verge requirement—currently, due to health and safety considerations, it is standard practice in the industry to avoid installing driven posts, or machine-excavated foundations, within 1000 mm of underground services—as a result, a great width of verge is required to install both services and vehicle restraint systems whilst allowing for the 1000 mm separation between the two. In contrast, the present system potentially allows for the vehicle restraint system to overlie any services with far less risk than conventional installation techniques, such that a narrower verge can be used; and (g) increased compliance with Highway Construction Details ("HCD")—there is, in principle, a requirement that any concrete used in the installation of the vehicle restraint system should be allowed to cure for 28 days before the road is opened to traffic. In practice this is frequently disregarded, but the use of a pre-fabricated concrete base unit allows the regulation to be observed.

In one embodiment, each attachment position on the base unit comprises a socket formed in, and optionally through, the base unit, such that a support post may be passed into, and preferably through, the base unit. The support post will typically extend about 300 to 500 mm below the base unit, preferably 250 to 350 mm. If desired, the socket may be provided with a sleeve or liner, which may optionally be removable from the base unit. The sleeve or liner is conveniently formed of metal such as steel.

In one embodiment, the sleeve or liner is dimensioned so as to be received snugly within the socket formed in the base unit, but may extend beneath the base unit by a length (e.g. 100-500 mm) suitable to accommodate a bottom part of a support post. The sleeve or liner may project above the base unit by an amount e.g. in the range 0-50 mm. The sleeve or liner, if formed as a separate component, removable from the base unit, may possess a small flange portion or collar, extending around the upper surface about the socket, so as to help retain the sleeve or liner in a desired position relative to the base unit.

In some embodiments the sleeve or liner may desirably be formed with a pointed, conical, or generally tapered or wedge-shaped lower end, to facilitate insertion into the ground beneath the base unit.

The sockets formed in the base unit may, in preferred embodiments, take the form of generally cylindrical apertures through the base unit which, in cross-section, may typically be circular or, more desirably square or rectangular in section. The most convenient shape is a rectangular section cylinder, which conforms to the shape and dimensions of commonly-used support posts (e.g. a 'Z'-section support post, although other commonly used support posts are formed with an 'H' or 'I'-shaped section; any of these can be accommodated by suitably shaped and dimensioned sockets in the base unit).

In other embodiments, the base unit may comprise a plurality of sockets, with or without metal sleeves or liners, and the support posts do not necessarily extend beneath the base unit.

In such embodiments, the base unit may conveniently be of increased dimension in depth around the sockets, compared to the majority of the base unit, so as to enhance the rigidity of the base unit around the sockets, the better to resist any force imposed as a result of a vehicle colliding with the vehicle restraint system. In addition, it may be advantageous to provide each socket with at least one drain hole, so that rain or other water cannot accumulate in the socket and facilitate corrosion or other degradation of a fence post within the socket.

In some embodiments, one or more sockets in the base unit may be provided with retaining means for retaining a support post within the socket. The retaining means is preferably readily releasable so that a support post retained in the socket can be readily removed if desired. In this way, if a support post is damaged (e.g. as a result of a vehicle colliding with the post or barrier), it may readily be replaced with a new support post. In one embodiment, the plurality of sockets in the base unit are each formed with a pair of bores in the walls thereof, one on each side of the socket, which are aligned. In use a retaining bolt or pin (e.g. made of steel) is inserted into one of the bores in the socket wall, and then passed through a corresponding pre-formed hole towards or near the base of the support post when the post is inserted into the socket, and thence into the other aligned bore in the opposite socket wall. For ease of removal of the retaining bolt or pin, it is preferable that the bores extend at least on one side, and desirably on both sides, right through the attachment point to an adjacent aperture. The retaining bolt is preferably releasably secured within the socket by a nut or the like.

In another embodiment, each attachment position on the base unit substantially corresponds to a conventional mounting position for a surface-mounted post.

A conventional surface-mounted post is typically formed with an H-shaped base plate, the two arms of the 'H' being flattened flange portions with a hole disposed towards each end, such that there are four holes in total in the base plate. Four corresponding holes are drilled in the road surface, foundation or other solid surface on which the surface-mounted post is to be positioned, and a metal anchor or fixing is placed in each of the holes in the solid surface and fixed therein by the curing of a synthetic resin. The base plate of the post is then attached to these anchors or fixings by positioning metal studs or fasteners, such that each stud or fastener passes through one of the holes in the base plate and enters into a strong, screw-threaded engagement with a respective one of the metal anchors or fixings in the solid surface.

Accordingly, in embodiments of the invention adapted and configured for use with surface-mounted posts, it may be desired for each attachment position to be provided with at least one (preferably a plurality) of pre-drilled or otherwise pre-formed holes, to indicate the desired position of metal anchors or fixings to be inserted to anchor the support post to the base unit. It is possible however, that at least some, or even all, of the holes in the attachment position are not pre-formed but are introduced in situ, typically by drilling. The post will then be attached to the base unit in substantially conventional manner by metal studs, fasteners, nuts or other securing means which enter into a screw-threaded engagement with the anchors or fixings already secured in the base unit.

Indeed, in a preferred embodiment of the invention for use with surface-mounted type posts, the (typically metal) anchors or fixings may be already present in the base unit as supplied to the construction site. In particular, it may be preferred to incorporate the anchors or fixings at the concrete-casting stage of the base unit (i.e. substantially at the outset), which eliminates the need to drill holes into the base unit, after the concrete has set, to accommodate the anchors or fixings.

It will be appreciated that, whilst it is possible that two or more different types of attachment position may be present on a single base unit, it will generally be advantageous that a single type of attachment position is present on a single base unit.

It is a preferred feature of the invention that opposed ends of the base unit are shaped so as to co-operate with the opposed ends of other base units in accordance with the invention. In one embodiment, one end of a base unit is shaped to form a male member, and the opposed end of the base unit is reciprocally shaped to form a female member, such that the male member of a first base unit may co-operate with the female member of a second base unit. A convenient selection of male and female members comprises a male member in the shape of a projecting trapezium or an inverted triangle with the apex truncated, and the female member being formed as a reciprocally shaped re-entrant trapezium or the re-entrant base of a truncated triangle. More especially, the opposed ends are desirably shaped and dimensioned so as to permit a first base unit to be moved in a substantially vertical plane relative to a second base unit, but so as to resist lateral (and/or rotational) relative movement in at least one direction in a substantially horizontal plane. In this way, a second base unit can be lowered into place, adjacent to, and in co-operating engagement with, a previously positioned first base unit.

Thus, for example, conveniently, once the abutting ends of adjacent base units have been placed in engagement, the base units may be separated by lifting one or other of the base units in a substantially vertical plane, but the base units cannot be separated by relative horizontal movement in a transverse direction at right angles to the long axis of the base unit. Where the first and second base units engage with an interlocking (e.g. dovetail) engagement, the base units will resist relative movement in any direction in a horizontal plane. In other simpler embodiments, relative movement in a horizontal plane generally along the long axis of the base units may still be permitted, but transverse movement generally at right angles to be the long axis of the base units is resisted. Such an embodiment thus permits a first base unit to be connected to a second base unit by relative horizontal movement thereof along the long axis of the aligned base units, or by relative vertical movement of the two aligned base units.

In yet another embodiment, the ends of adjacent base units are adapted and configured so as to allow for at least some relative rotational or pivotal movement in a horizontal plane. As an example of such an embodiment, the base unit may be formed with a projecting male member at one end and a reciprocally shaped female recess at the other end, wherein the male member has a curved face, which may preferably describe a substantial part of a circle. Where the male member is semi-circular or describes less than half of a circular arc, and the female recess is reciprocally shaped and is a semi-circular recess or describes less than half of a circular arc, then the opposed male and female ends of adjacent base units can be engaged and disengaged by simple relative longitudinal movement, pushing the two base units together to engage, or pulling them apart to disengage.

However, if desired, the base units may be formed with a projecting male member which describes an arc of more than 180° of a circle (eg. 220-270°), and the reciprocal female recess similarly describes an arc of greater than 180°. In such an embodiment, there is an interlocking engagement between the male member and female recess, such that the opposed ends of adjacent base units cannot be engaged or disengaged by simple relative longitudinal movement in a horizontal plane, but can be engaged or disengaged by relative vertical displacement.

In such embodiments as described in the immediately preceding paragraphs, one or both ends of the base unit are preferably formed with an angled shoulder portion, which permits a greater angle of relative rotational or pivotal movement between adjacent, engaged base units.

It will be apparent that, in embodiments of the invention which allow for some limited relative rotational or pivotal movement of adjacent base units, adjacent base units can be engaged with one another (eg. by relative vertical displacement, sliding or dropping one base unit into engagement with its neighbour), and rotated through a desired angle to impart a desired change of direction or 'kink' in a run of base units.

In addition, or as an alternative, to the aforementioned shaped co-operating ends of adjacent base units, in some embodiments the base unit may be provided with connecting means, which functions to connect the opposed ends of adjacent base units. For example, in one embodiment, one or more bores (preferably two) are provided at each end of a base unit), which bores are preferably sufficiently long to communicate with the aperture nearest the end of the base unit. In this way a metal bolt, tie or the like may be inserted into one end of a bore, and pass through into an aligned, co-operating bore formed in the end of the adjacent base unit, and secured therein by a nut or other fastener. Typically an M24 (i.e. 24 mm diameter) bolt and associated nut is suitable for this purpose. M24 bolts are readily available commercially in lengths up to about 240 mm. Conveniently a pair of bores is formed at each end of the base unit.

In preferred embodiments, the ends of the base unit are made, and/or the base units positioned, in such a way as to allow for thermal expansion and contraction of the base unit. For example, for a base unit substantially consisting of concrete, an 8000 mm long base unit might be expected to extend or contract in length by up to 4 mm.

Generally the ends of the base unit will be perpendicular to the long axis of the base unit. However it may be convenient for some base units to have at least one end which is at an angle of e.g. between 5 and 40 degrees to the long axis of the base unit, where the base unit is to be installed along a curved section of carriageway. It will be apparent that, if desired, both opposed ends of the base unit may be set at an angle to the long axis of other than 90°. This angle may be the same at both ends, or may be different.

It may be desirable, in some embodiments, for the base unit of the invention to be held in place by bracing means. This may be especially desirable where the ground is insufficiently stable to provide adequate support for the base unit and/or where the base unit is to be installed on a narrow verge at a roadside. The bracing means may, for example, comprise a stake or post, typically of metal (e.g. steel) which is driven into the ground. The bracing means might act on a front or rear edge of the base unit. Additionally or alternatively the base unit may be provided with one or more bracing holes (e.g. formed in the transverse portions and/or at the end regions of the base unit), through which a bracing stake or post may be driven. The bracing means may advantageously be secured in place by concrete, or the bracing means may be provided with a welded plate, flange or collar which can be attached to the base unit by a conventional "surface mounted" technique, of the sort already described elsewhere. In one embodiment, the base unit is formed with one or more bracing holes of 120×50 mm dimension, which accommodate a widely-used metal post acting as a bracing means.

In a second aspect, the invention provides a system for installing a vehicle restraint system at a desired location, the system comprising a pre-fabricated base unit in accordance with the first aspect of the invention defined above, in combination with at least one support post adapted and configured for attachment to the base unit at a selected one of the plurality of attachment positions provided on the base unit.

More preferably two or more support posts are attached to respective attachment positions on the base unit.

In one embodiment, the system is one in which the base unit is provided with at least one socket at each support post attachment position, the system further comprising a sleeve or liner for insertion into at least one of the aforementioned sockets.

Typically the system comprises a plurality of modular sections of base unit, and a plurality of support posts.

The system may additionally comprise a conventional crash barrier adapted and configured for mounting on the at least one support post, more preferably for mounting on a plurality of support posts, which are positioned on one or more base units in accordance with the first aspect of the invention.

In a third aspect, the invention provides a method of installing a vehicle restraint system, the method comprising the steps of:

(i) positioning a selected pre-fabricated base unit in accordance with the first aspect of the invention at a desired location; and (ii) anchoring at least one support post to the base unit.

The method will generally further comprise the step of (iii) attaching the vehicle restraint or crash barrier to the anchored support post. Preferably a plurality of support posts will be anchored to the base unit, and typically a plurality of such base units will be deployed, each having a plurality of anchored support posts.

The method may also advantageously comprise an initial step of excavating a trench of length and width suitable to accommodate one or more of the selected pre-fabricated base units. Desirably the trench is dug by machine. The depth of the trench may depend on several factors, including, for example: the depth below ground level of any underlying services (such as drains, sewers, electric cables or gas pipes); communication cables or hard ground. Typically the trench will be 150-250 mm in depth.

It will be appreciated that the method of the third aspect of the invention will normally involve positioning a plurality of base units, most or all of which will be of substantially identical design and construction (i.e. modular). Desirably the end of one base unit will be shaped and dimensioned so as to engage with the opposed end of another base unit, such that the step of positioning the base units may involve placing adjacent base units into engagement or even interlocking relationship with one another. Optionally, in addition, or as an alternative, to the aforementioned engagement, connecting means such as metal bolts or ties may be inserted into bores provided at the ends of adjacent base units, and secured with nuts or other fasteners, the bores of adjacent base units being aligned to receive the bolts.

If any preliminary excavation has been required, some or all of the spoil may be back-filled onto the base unit once the support posts have been anchored to the base unit. This back-filling may be performed before or after the vehicle restraint member/crash barrier has been attached to the support posts.

In some embodiments, the top of the base unit when installed may be slightly below the level of the surface of the carriageway, such that surface water on the carriageway may be readily drained onto the base unit and then pass through the apertures therein. In other embodiments, the top of the base unit when installed may be substantially level with the surface of the carriageway. In still other embodiments, when installed the top of the base unit may be above the surface of the carriageway, typically about 100-125 mm above the surface of the carriageway. This arrangement has the advantage that the base unit may form a kerb or edging to the carriageway. However, the side wall of the base unit may then tend to prevent drainage of surface water from the carriageway onto the verge and/or onto the base unit. To avoid this, the side wall of the base unit may be provided with one or more drainage gaps to allow water from the carriageway to drain into the base unit.

In some embodiments, the base unit may be mounted or positioned on an underlying conduit unit. The conduit unit may be a separate pre-fabricated component, or may form an integral sub-component of the base unit. The conduit unit is conveniently formed of concrete. It is preferred that the conduit is separate from the base unit, as this aids removal of the base unit and the conduit unit in the event that access is required to the services etc. located beneath the conduit unit. The conduit unit may be provided in sections of the same length as the base unit, or may be different (longer or shorter than the base unit). In one particular embodiment, the conduit unit is provided in pre-fabricated lengths of 2 metres or so (e.g. substantially shorter than the base unit) in order to facilitate removal of one or two selected individual conduit units if desired.

In a preferred embodiment the conduit unit has a cross-section resembling adjacent, conjoined, letters "n" and "u", such that the conduit unit substantially possesses rotational symmetry of order 2 about its long axis.

The "n" shaped part of the conduit unit may form a protective arch over services, laid beneath the conduit unit. The services may comprise, for example, electrical cables, gas pipes and the like.

The "u" shaped part of the conduit unit may form a drainage channel to drain away surface water which falls onto the structure or which drains onto the structure from the surface of the carriageway.

In some embodiments the base unit and the conduit unit are provided as separate components. In this event, it is desirable that positioning guide means is provided on one or both units to assist in placing the base unit in a desired position relative to the conduit unit. An example of such positioning guide means is to have co-operating surfaces formed on the base unit and conduit unit, which guide means are formed with a stepped profile, e.g. a profile on the upper edge of a conduit unit which co-operates with a reciprocally stepped profile on the bottom edges of the base unit.

In other embodiments, the base unit and conduit unit may form a single integrated component. For example, they may be cast ab initio as a single component in concrete, or they may be cast separately but assembled together after manufacture for delivery onsite as a single, pre-assembled component.

As noted above, an advantage of the base unit of the first aspect of the invention is that it is reusable. Accordingly in some methods in accordance with the third aspect of the invention, there may be a preliminary step of obtaining the selected pre-fabricated base unit by digging up and/or repositioning a previously deployed base unit. For example, where a base unit has been deployed to support a vehicle restraint at a temporary site, the base unit may subsequently be reused at a second or further location.

The fabrication of the base unit may be achieved by essentially conventional manufacturing techniques known in the industry, but with minor adaptations suitable for the invention. Thus, for example, a concrete base unit in accordance with the invention may be made by pouring concrete into the mould cavity space of a metal mould of the desired size and shape. Desirably the wet concrete used is of grade ST5 or greater.

Prior to, during, or immediately after, the pouring of the concrete into the mould cavity, any desired metal reinforcing components will also be introduced into the mould cavity. In some embodiments (especially those intended for use with conventional surface-mounted posts), metal anchors or fixings will also be located, at desired positions, in the mould cavity. A jig is conveniently employed to ensure accurate positioning of the metal anchors or fixings, which latter will form an integral part of the base unit once the concrete has set.

In a fourth aspect, the invention provides a system for installing a vehicle restraint barrier at a desired location, the system comprising a length of pre-fabricated base unit locatable in the ground at the desired location, the base unit having a plurality of reception sites for receiving at least one individual attachment unit for attachment thereto of a substantially vertical support post for supporting the vehicle restraint barrier.

In a preferred embodiment, the system of the fourth aspect of the invention comprises a base unit as aforesaid in combination with at least one individual attachment unit, more preferably in combination with a plurality of individual attachment units.

The reception sites on the base unit are desirably predetermined, and conveniently are at a fixed, and preferably regular, interval along the base unit.

In a typical embodiment in accordance with the fourth aspect of the invention, the base unit takes the form of a rectangular frame, with a pair of substantially identical side members which are joined at or near their ends by a pair of substantially identical end members. The base unit conveniently consists, or is substantially formed, of concrete or reinforced concrete. Equally the individual attachment units conveniently consist, or are substantially formed, of concrete or reinforced concrete.

Desirably, each of the reception sites present on the base unit is essentially identical, such that an individual attachment unit may be received at any one of the plurality of reception sites on the base unit. Typically, the attachment units are received within the frame of the base unit, so as to form cross-pieces within the frame and, when received in the reception site, may resemble the transverse 'rung' arrangement described in relation to the first aspect of the invention defined above. It is a highly preferred feature of this aspect of the invention that the individual attachment units are removably received within the reception sites, preferably slidably removably received, and most preferably substantially vertically slidably received.

Advantageously, each of the plurality of reception sites on the base unit comprises a pair of shaped recesses, formed opposite one another on the opposed side members of the base unit. Each of the individual attachment units is preferably provided with a pair of projections which are shaped reciprocally to the recesses formed at the reception sites. It will be appreciated however that the opposite arrangement could also be employed i.e. each of the plurality of reception sites comprises a pair of projections formed opposite one another on the opposed side members of the base unit, and each individual attachment unit is provided with a pair of recesses, shaped reciprocally to the projections at the reception sites. Desirably there is a frictional fit between the attachment unit and the base unit. More especially, the shape of the reception sites and the shape of the individual attachment units is such that the attachment units may be removably inserted into a reception site by dropping in the attachment unit into the base unit from above. In one embodiment the pair of recesses are formed with a dovetail fan shape and the projections are reciprocally shaped, so as to form an interlocking engagement between the attachment unit and the base unit.

Any desired number of individual attachment units may be inserted into the base unit, such that all or fewer of the reception sites in the base unit may be occupied by an individual attachment unit. Typically however, in use, between 2 to 4 attachment units may normally be introduced in the base unit, which base unit may typically comprise any number of reception sites between about 4 to 15, more preferably 6 to 13.

When the desired number of attachment units has been introduced into a base unit in accordance with the fourth aspect of the invention, the resulting combination is essentially functionally equivalent to a base unit in accordance with the first aspect of the invention, and the description of the features and method of use of the base unit of the first aspect of the invention will generally be applicable to the combination of base unit and individual attachment units in accordance with the fourth aspect of the invention.

The individual attachment units of use in a combination in accordance with the fourth aspect of the invention typically comprise or are formed with an attachment position functionally equivalent to those present on a base unit in accordance with the first aspect of the invention. Thus, for example, the individual attachment units may be adapted and configured for attachment to a support post by means of a socket (with or without a liner) or by means of a surface-mounting type of attachment for a support post, as described above in relation to a base unit in accordance with the first aspect of the invention.

The person skilled in the art will appreciate that the system in accordance with the fourth aspect of the invention affords great flexibility and versatility in terms of arrangement, number and spacing of support posts. For example, a small number of support posts may be used initially during the construction phase of a road, when there is only construction traffic using the road and the chance of a high speed impact on a supported vehicle restraint barrier is very low. When the project is nearing completion, a greater number of attachment units may be introduced into the base unit, to accept a greater number of support posts and a higher specification vehicle restraint barrier.

Another illustration of the advantages of the system of the fourth aspect of the invention is that the positioning of the individual attachment units within the base unit can be adjusted if desired, to avoid local obstacles (e.g. services, foundations etc.) beneath part of the base unit.

The invention will now be further described by way of illustrative example and with reference to the accompanying drawings, in which.

EXAMPLES

Example 1

Figure 1A:
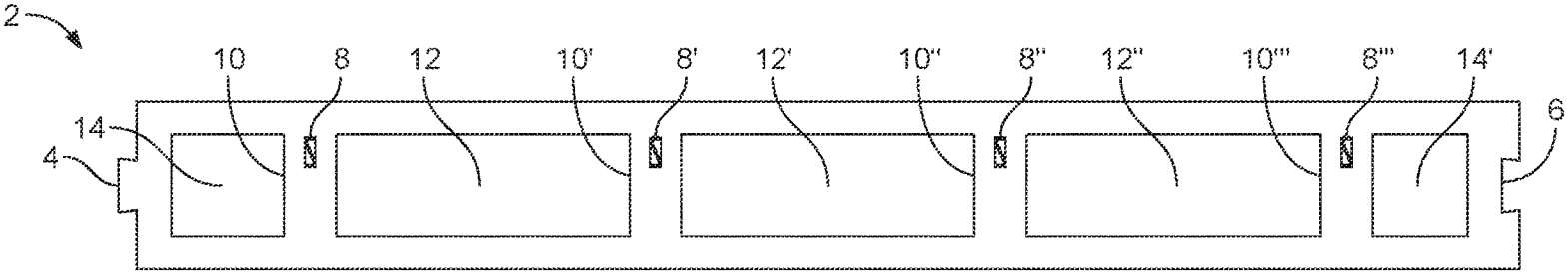
FIG. 1A is a plan view of one embodiment of the invention.

A first embodiment of the invention is shown in plan view in FIG. 1A. The apparatus comprises a pre-fabricated base unit 2 of reinforced concrete. The base unit is about 8 m long, 1000 mm wide, and 200 mm deep. A first end of the base unit is formed with a projecting male member 4, whilst an opposed second end of the base unit 2 is formed with a re-entrant female member 6. The male member 4 and the female member 6 are reciprocally shaped, so that the male member 4 of a base unit 2 can be received within the female member 6 of another base unit 2 so as to create an interlocking engagement, which permits relative movement of the two base units in a substantially vertical plane, but resists relative lateral movement in a substantially horizontal plane.

Figure 1B:
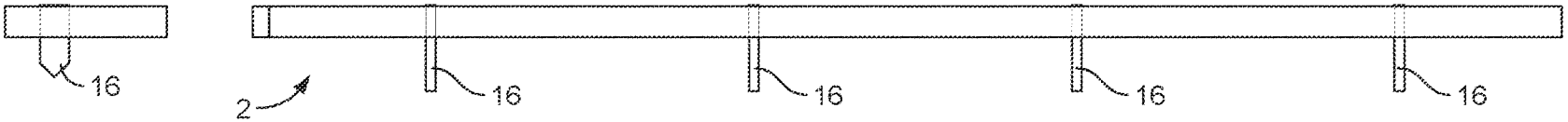
FIG. 1B is a side elevation of the embodiment shown in FIG. 1A, with additional accessories.

The base unit comprises four attachment positions 8-8''', which are at a fixed interval of 2000 mm. Each of the attachment positions 8-8''' comprises an identical socket through the entire depth of the base unit 2. As best seen in FIG. 1B, each socket is provided with a removable steel liner or sleeve, locatable within the socket and extending beneath the base unit 2 into the ground below. The socket is of rectangular cross-section, shaped and dimensioned to receive and retain the liner or sleeve, which is in turn shaped and dimensioned to receive the end of a commercially-available Z-section support post of common and conventional design.

Each attachment position 8-8''' is provided in a respective 'rung' 10-10''' across the base unit. Between adjacent rungs 10-10''' is a large aperture 12-12'' formed in the base unit. Additional smaller apertures 14,14' are provided towards opposite ends of the base unit. The highly apertured nature of the base unit facilitates access to, and inspection, maintenance or repair of, any services underlying the base unit 2 when it is in situ along the edge of a road carriageway.

In order to use the apparatus, a trench of suitable dimensions is excavated at the desired location and the base unit is lowered into the trench. A steel sleeve or liner 16 (seen in FIG. 1A) is placed in each of attachment positions 8-8''' and driven into the ground, and a support post is then inserted into each steel sleeve or liner 16. The dimensions of the sleeve or liner are such that a widely-used, commercially available support post may be snugly received within the sleeve or liner 16, so as to be firmly anchored by the sleeve and base unit. The mass and rigidity of the base unit 2 allows the support posts to be firmly anchored without driving the posts to the depth of penetration which would be required in the absence of the base unit.

Once the support posts have been anchored to the base unit, the spoil excavated in the digging of the trench may be partially or wholly back-filled on top of the base unit 2, depending on the requirements of the constructor, and the vehicle restraint barrier or crash barrier is attached to the anchored support posts by wholly conventional means (e.g. nuts and bolts).

In the embodiment illustrated, the sleeve or liner 16 is shaped and dimensioned so as to snugly receive a conventional 170×49 mm 'Z' section post.

Figure 1C:
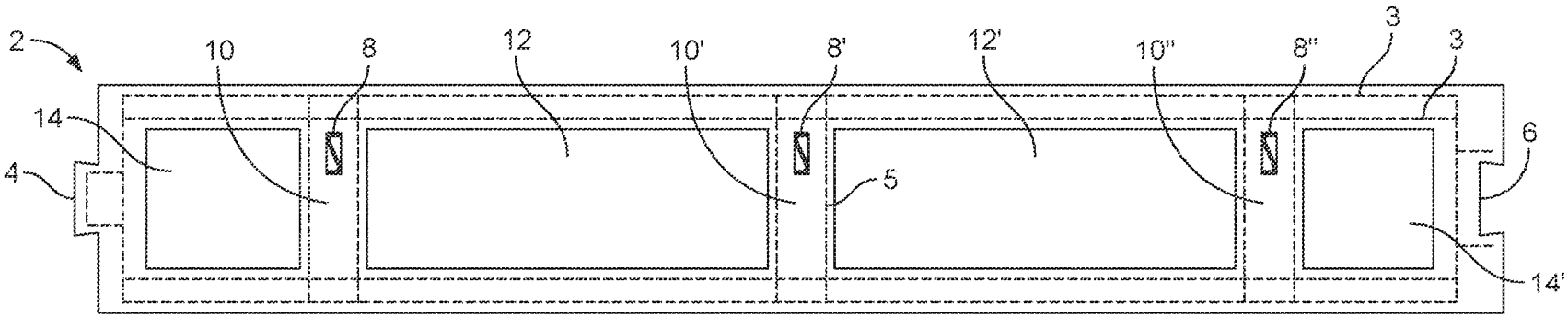
FIGS. 1C and 1D are illustrations of the layout of integral steel reinforcement bars within one embodiment of the invention, as seen from above (1C) or one side (1D)
Figure 1D:
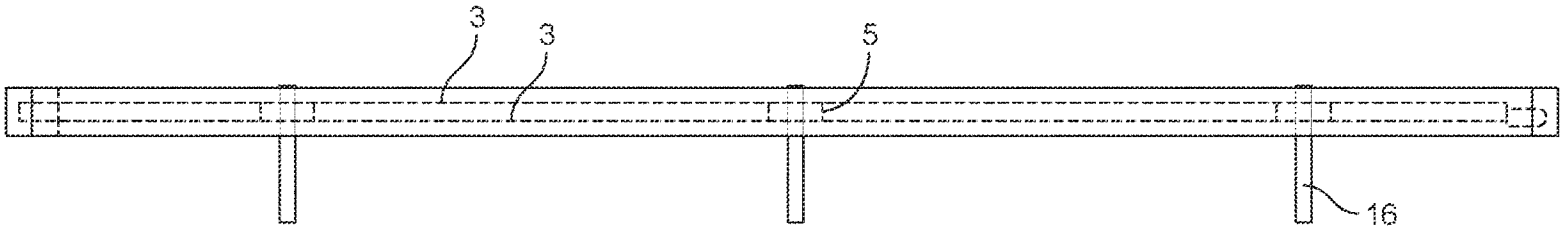

FIGS. 1C and 1D illustrate an embodiment generally similar to that illustrated in FIGS. 1A/1B (although shorter, and with fewer 'rungs' 10 and apertures 12), and like components are denoted with common reference numerals. The Figures illustrate the internal arrangement of the integral steel reinforcing bars provided in the base unit. These comprise four parallel pairs of main bars 3 along the long axis of the base unit, which are joined by a plurality of transverse members, of which a representative example is denoted by reference numeral 5. The transverse members are situated within the 'rungs' 10. All the bars 3, 5 are of conventional H10 size. It is apparent from the Figures that the reinforcement bars do not protrude into the apertures 12.

Figure 1E:
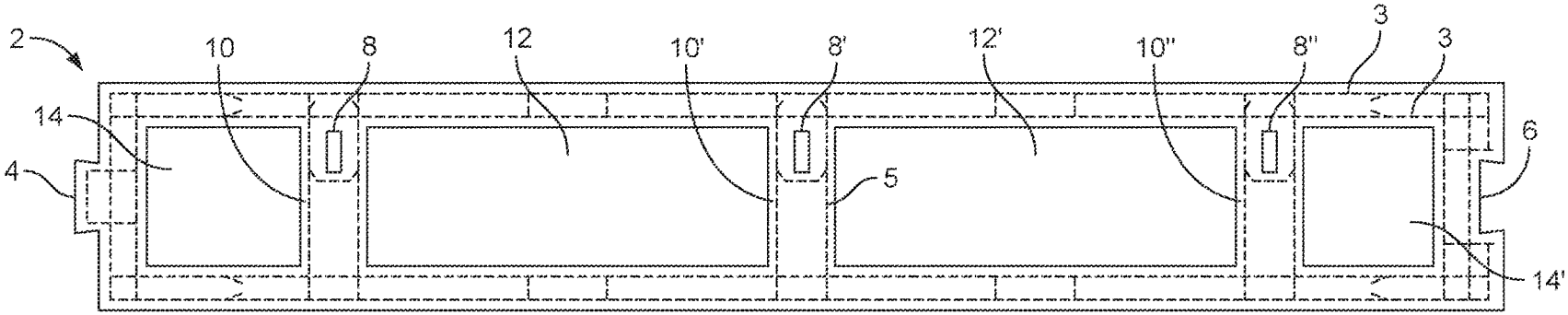
FIG. 1E is an illustration of an alternative layout of integral steel reinforcement bars within an embodiment of the invention, as seen from above.

FIG. 1E is a plan view of a further embodiment illustrating the internal arrangement of integral steel reinforcing bars provided in the base unit. The arrangement is generally similar to that shown in FIG. 1C (and like components are denoted with common reference numerals). The arrangement of reinforcing bars illustrated in FIG. 1E is slightly more extensive than in FIG. 1C. In particular, there are two or three transverse bars at the opposed ends of the base unit, and an extra reinforcing bar is provided within the 'rungs' 10, 10', 10'' at the respective attachment positions to provide additional strength at those locations. The reinforcing bars are of conventional H10 or H12 size.

Example 2

Figure 2A:
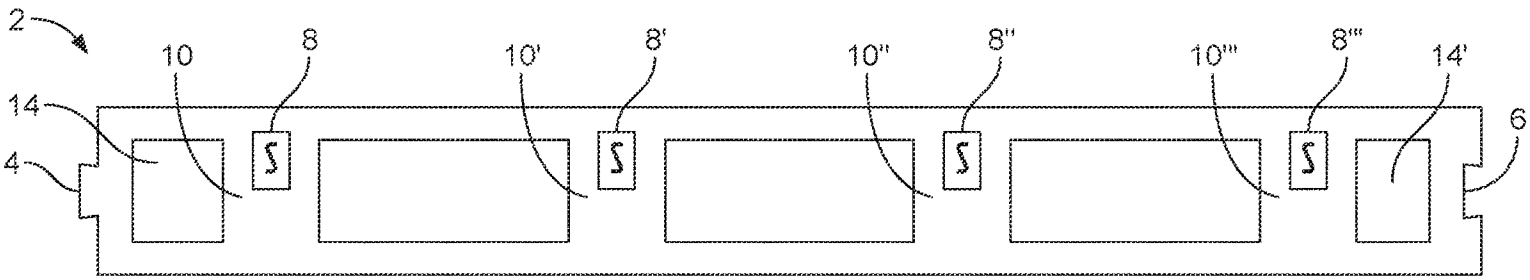
FIG. 2A is a plan view of a second embodiment of the invention.

A second embodiment of apparatus in accordance with the first aspect of the invention is shown in plan view in FIG. 2A. The embodiment is generally similar to the embodiment shown in FIG. 1A, and like features are denoted by common reference numerals.

In the embodiment shown in FIG. 2A, each attachment position 8-8''' placed at intervals of 2000 mm comprises a shallow rectangular recess within which is preferably located a thin steel plate (about 3 mm in depth). The thin steel plate avoids the need for a conventional on-site poured grout pad, which takes time to install and additional time to cure. A surface-mounted support post is mounted at the indicated attachment position. The mounting is typically performed by drilling a plurality of holes into the pre-fabricated base unit 2. The support post, with its attached (e.g. welded) base plate, is then anchored by inserting a plurality of metal bolts, studs or other fasteners through the base plate on the support post into screw-threaded engagement with a corresponding metal anchor or fixing secured in the base unit 2.

If desired, one or more of the attachment holes in the base unit 2 may be pre-drilled in the pre-fabricated base unit 2 prior to delivery to the construction site, or less preferably each of the attachment holes is drilled in situ. More preferably the metal anchors or fixings are incorporated into the base unit at the concrete-casting stage, which avoids the need to drill holes for the fixings after the concrete has set.

Accordingly, with preferred embodiments of the invention, there is no requirement for on-site drilling, or grout pad curing, which in turn means there is no requirement for on-site testing of the anchors, and the vehicle restraint/crash barrier can be installed immediately after the posts have been anchored to the base unit 2. This is not possible with conventional methods of installing vehicle restraint systems. (Also, with conventional methods, a return visit is required to remove the shuttering used to form the shape and position of the poured grout pads—this is avoided by the present invention).

In the embodiments illustrated in FIGS. 1A and 2A, the attachment positions 8-8''' are shown offset from the centre line of the base unit. However, it is equally feasible for the attachment positions to be located along the centre line of the base unit. In other embodiments, where it is intended to locate two crash barriers e.g. along a central reservation, the base unit may comprise a pair of attachment positions at each of the "rungs" 10, the attachment positions being offset to opposite sides of the centre line, so as to allow the anchoring of two rows of support posts, with a respective crash barrier being attached to each row of support posts.

Example 3

Figure 3:
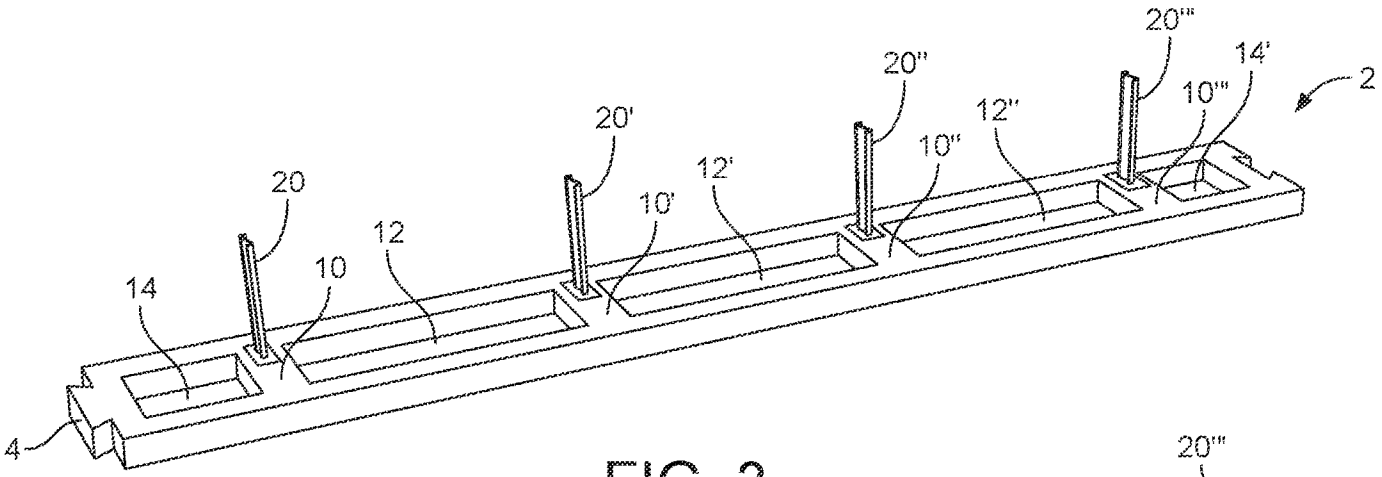
FIGS. 3 and 4 are perspective views of a system for installing a vehicle restraint system in accordance with the second aspect of the invention.

Referring to FIG. 3, there is illustrated a system in accordance with the second aspect of the invention. The system comprises a base unit 2, of the embodiment shown in FIGS. 1A & 1B, together with a plurality of vertical support posts 20-20'''. Each support post 20-20''' is a conventional Z-section steel post, which is received in a respective one of the corresponding attachment positions 8-8''' (shown in FIG. 1A) and the associated sleeve or liner 16 (shown in FIG. 1B).

A conventional horizontal steel crash barrier can be attached to the support posts 20-20''' by nuts and bolts, the support posts being apertured to permit the passage of suitably sized bolts.

Figure 2B:
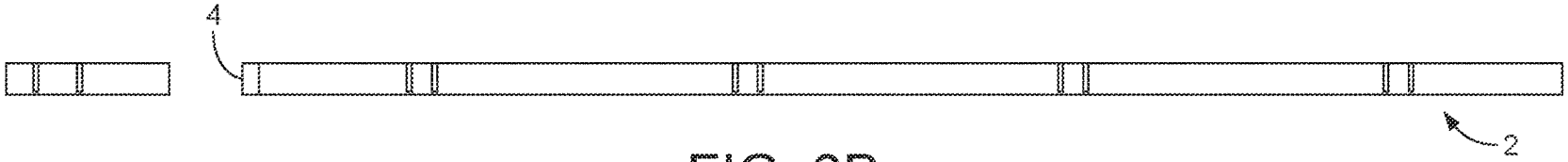
FIG. 2B is a side elevation of the embodiment shown in FIG. 2A.
Figure 4:
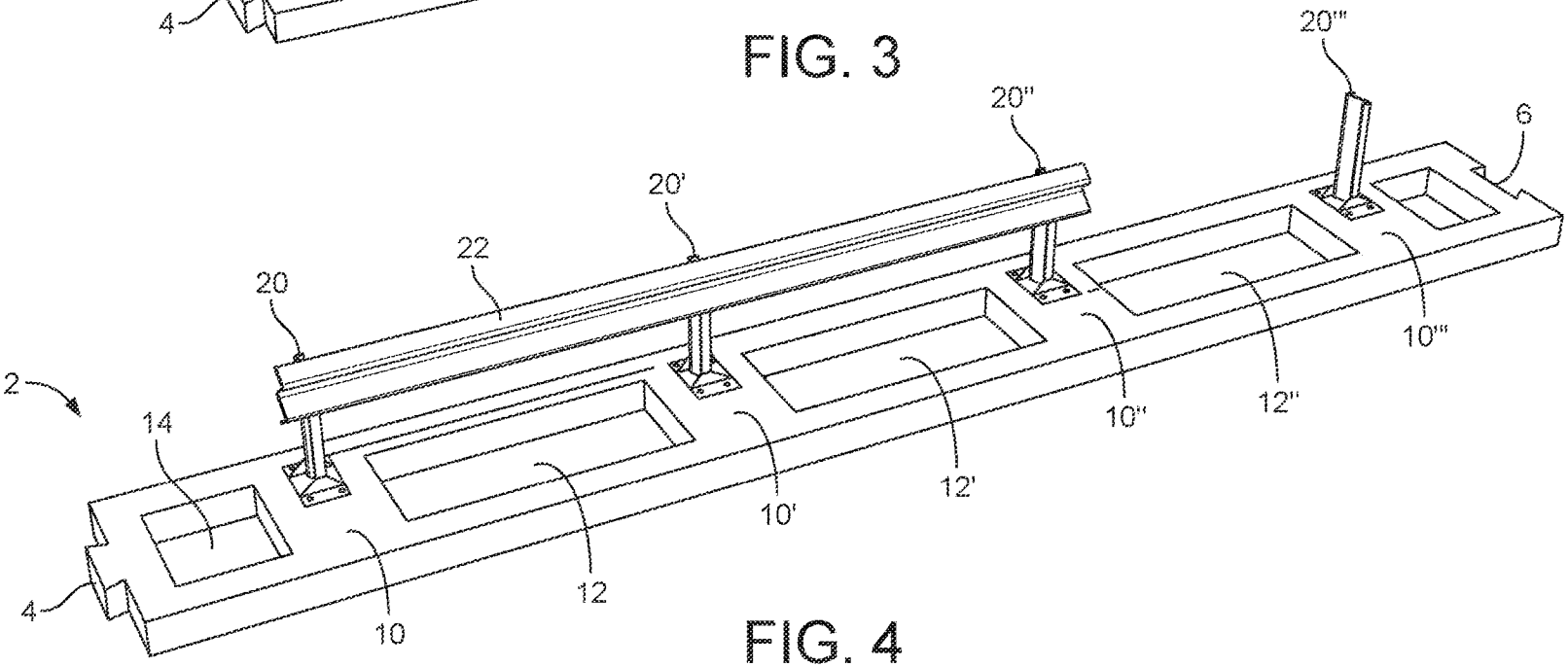

A further example of a system in accordance with the second aspect of the invention is shown in FIG. 4. The illustrated example comprises a base unit 2, of the embodiment illustrated in FIGS. 2A and 2B. At each of the plurality of attachment positions on the base unit is a vertical support post 20-20'''. These are anchored to the base unit 2 via their integral base plate, of the type used conventionally to anchor a surface-mounted post. The support posts 20-20''' with welded base plate are anchored to the base unit 2 by two-part metal bolts sunk into holes drilled into the base unit 2. A bottom part or anchor is positioned in the base unit; and a top part is passed through a pre-formed hole in the base plate and into screw-threaded engagement with the bottom part or anchor. Conveniently the bottom part or anchors are incorporated into the base unit at the casting stage, which avoids the need for subsequently drilling holes into the base unit, after it has set, to accommodate the anchors. Four two-part bolts are used, one at each corner of the base plate, and a liquid synthetic resin is used to fill the residual volume. The resin is allowed to cure, such that the base plates, and their attached support posts 20-20''', are firmly anchored. A conventional 'W'-section steel crash barrier 22, is then attached in a substantially horizontal plane to the substantially vertical support posts 20-20'''. Again, the attachment is by use of conventional fixings, such as nuts and bolts.

It will be noted that the base unit 2 in FIGS. 2A/2B and FIG. 4 differs in certain details from the base unit 2 shown in FIGS. 1A/1B and FIG. 3. An obvious difference is the absence of sockets penetrating through the entire depth of the base unit in FIGS. 2A/2B/4. In addition it can be seen that, because the system in FIG. 4 requires the use of base plates, having a relatively wide base, to attach the vertical support posts 20 etc., the transverse members 10 are substantially wider than the corresponding transverse members of the base unit shown in FIG. 3.

Example 4

Figure 5A:
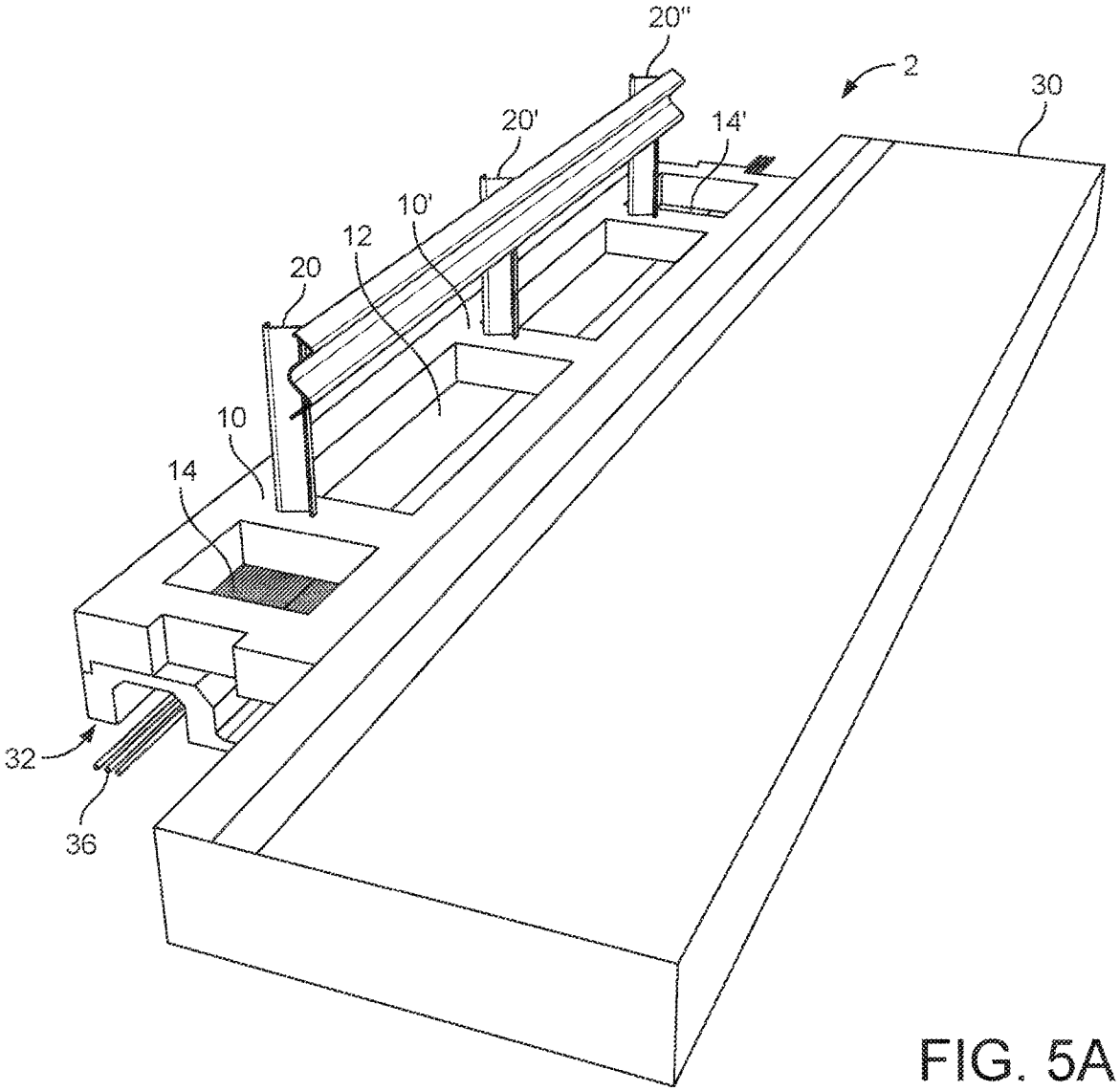
FIGS. 5A and 5B are perspective views of a further embodiment of a system for installing a vehicle restraint system in accordance with the second aspect of the invention.
Figure 5B:
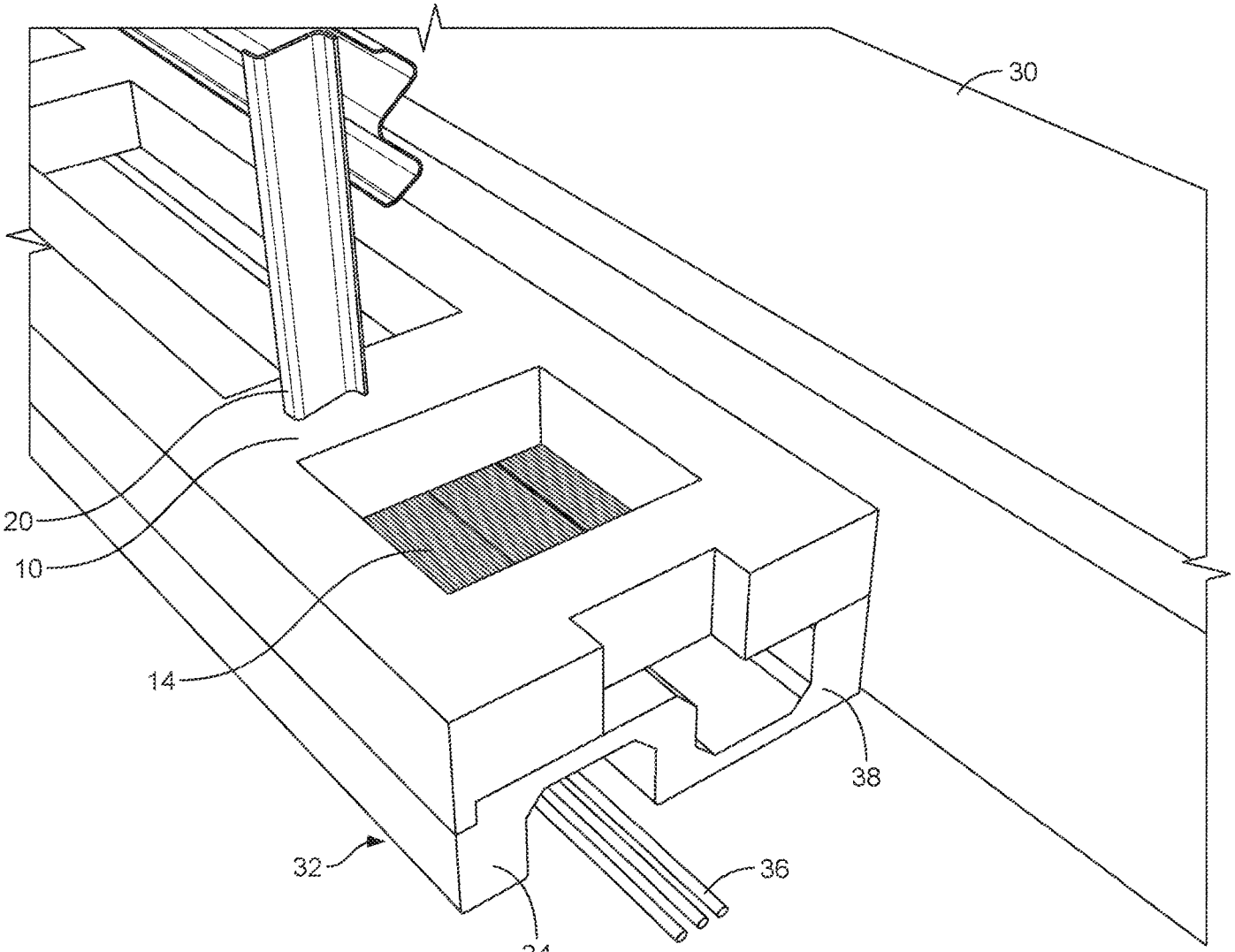

FIGS. 5A and 5B illustrate a further embodiment of a system in accordance with the second aspect of the invention. The illustrated embodiment is generally similar to that shown in FIGS. 3 and 4, and common reference numerals are used to indicate like components.

FIGS. 5A and 5B (drawn to different scales) show the system installed in situ along the outer edge of a carriageway 30. As best seen in FIG. 5B the base unit 2 is mounted above a pre-fabricated services conduit unit 32. The conduit unit 32 has a cross-section resembling conjoined adjacent letters "n" and "u", such that the conduit unit substantially possesses rotational symmetry of order 2 about its long axis. The conduit unit is conveniently formed of concrete.

The "n" shaped part 34 of the conduit unit 32 forms a protective arch over services 36, laid beneath the conduit unit. The services may comprise, for example, electrical cables, gas pipes and the like.

The "u" shaped part 38 of the conduit unit 32 forms a drainage channel to drain away surface water which falls onto the structure or which drains onto the structure from the surface of the carriageway 30, which is substantially flush with the top of the base unit 2. In this way, the system can help reduce the build-up of standing water on the surface of the carriageway.

One or more of the apertures 12, 14 etc. in the base unit are provided with a metal (e.g. steel) mesh which permits the passage of rain or other precipitation into the channel 38, whilst preventing the ingress of soil, leaves and the like which might otherwise partially or wholly block the channel 38.

The mesh is not embedded within the concrete of the base unit 2 but is instead readily removable from the base unit, being attached thereto by releasable attachment means, such as screws, clips or the like, or simply resting on a flange or ledge portion of the base unit. The mesh has an array of square holes of about 10 mm sides, and may be covered by an optional layer of drainage-permitting material such as 20 mm flint filter stone or similar.

In the illustrated embodiment, the prefabricated base unit 2 and the prefabricated conduit unit 32 are shown as separate components, the outer edges of the conduit unit 32 having a stepped profile which engages with a co-operating profile on the outer edges of the base unit 2. This engagement facilitates alignment of the base unit 2 with the conduit unit 32 such that the base unit can easily be placed in the desired position relative to the conduit unit.

In other embodiments, the base unit 2 and conduit unit 32 may form a single integrated component. For example, they may be cast ab initio as a single as a single component in concrete, or they may be case separately but assembled together after manufacture for delivery onsite as a single, pre-assembled component.

Example 5

Figure 6A:
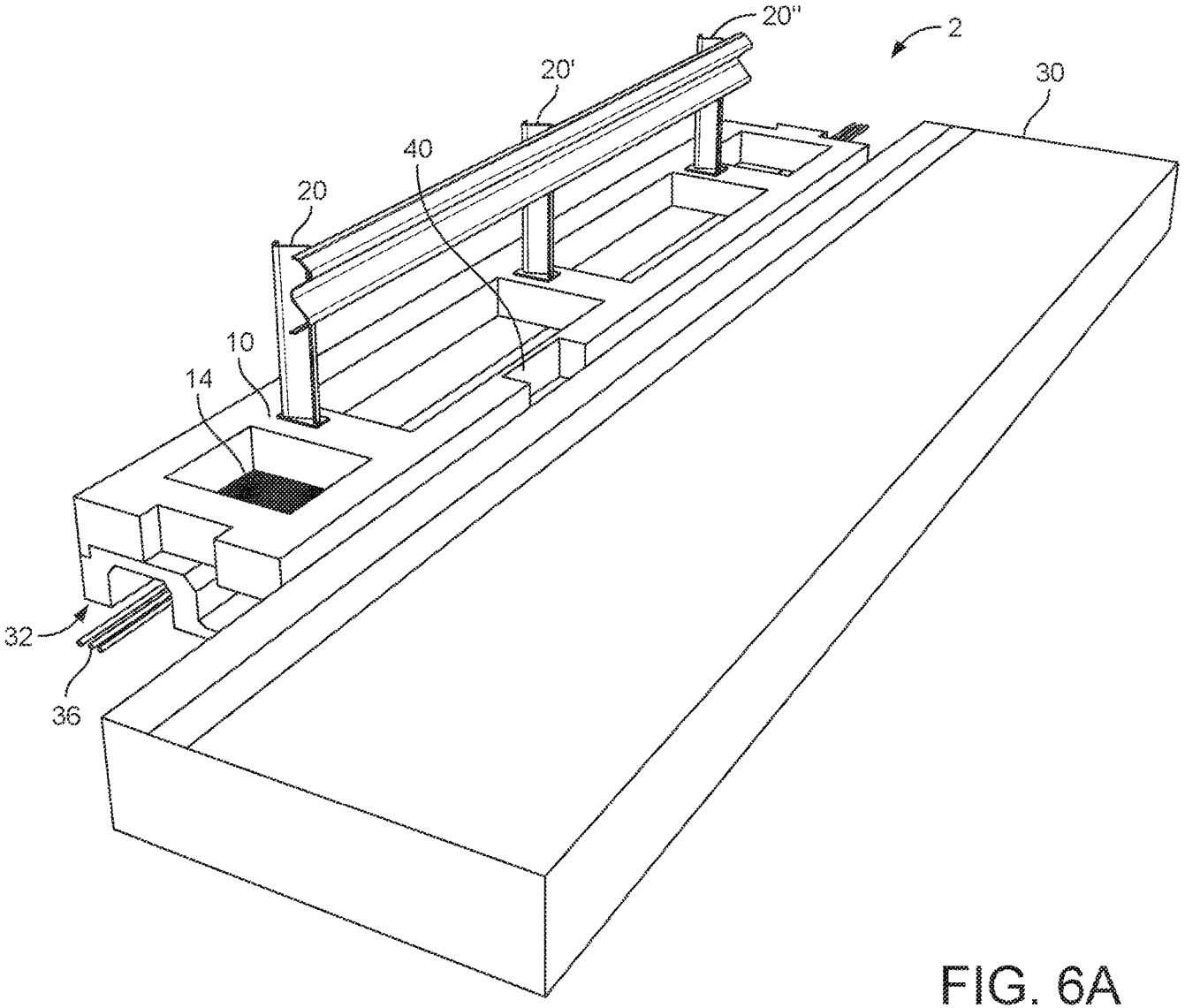
FIGS. 6A and 6B are perspective views of yet another embodiment of a system in accordance with the invention for installing a vehicle restraint system.
Figure 6B:
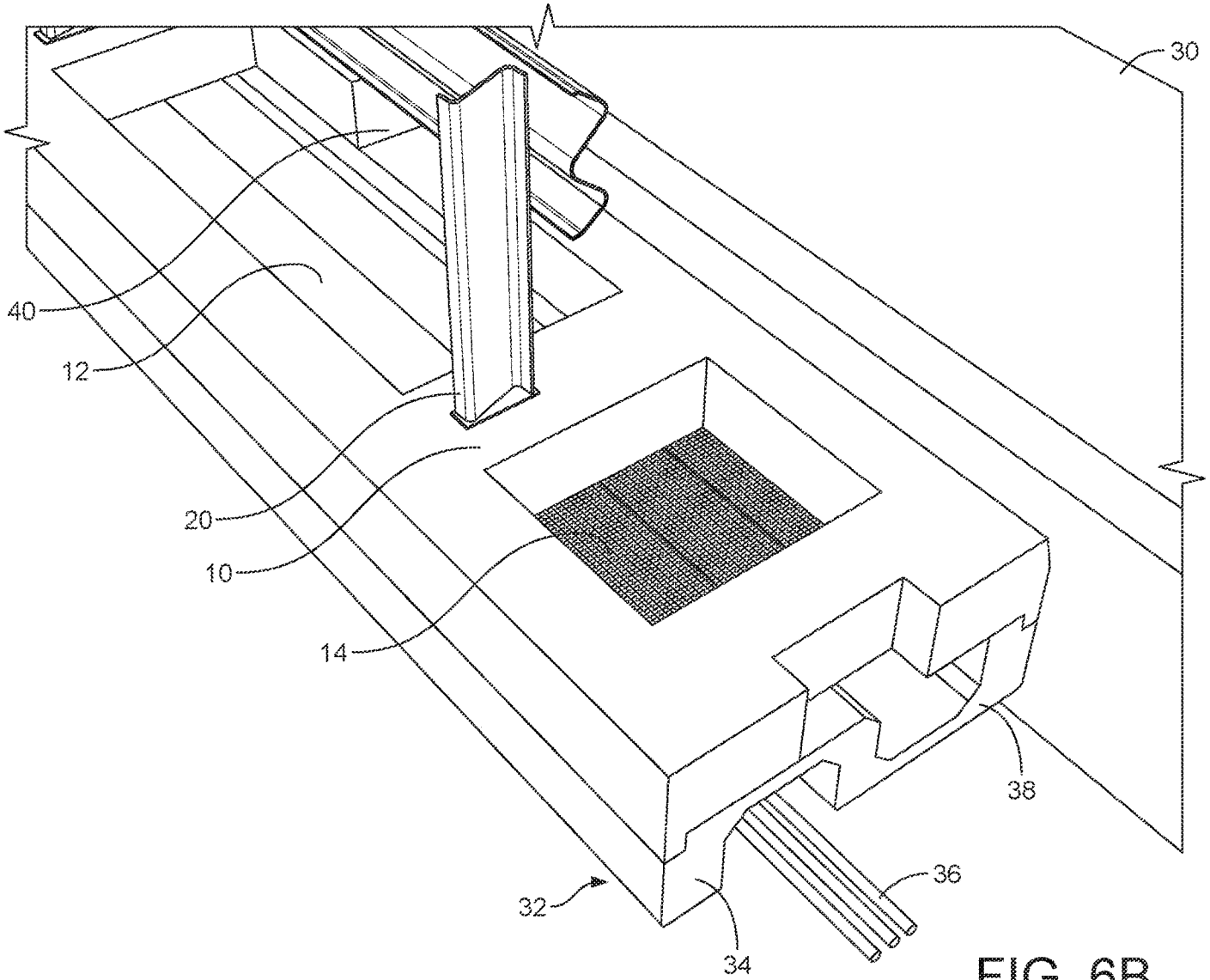

FIGS. 6A and 6B illustrate a further embodiment of a system in accordance with the second aspect of the invention. The embodiment is extremely similar to that shown in FIGS. 5A/5B and common reference numerals are used to denote like components.

The embodiment shown in FIGS. 6A and 6B is largely identical to that described in Example 4 above, except that in this example, the top of the conduit unit 32 is substantially flush with the surface of the carriageway 30, and the base unit 2 is above the level of the carriageway and thus forms a kerb or edging to the carriageway. In this embodiment, as the top of the base unit 2 is above the carriageway 30, one or more drainage gaps 40 are provided along the side wall of the base unit 2 which is adjacent the carriageway, which drainage gaps 40 facilitate the passage of rain water or other liquids from the surface of the carriageway into the drainage channel 38 formed in the conduit unit 32.

Example 6

Figure 7A:
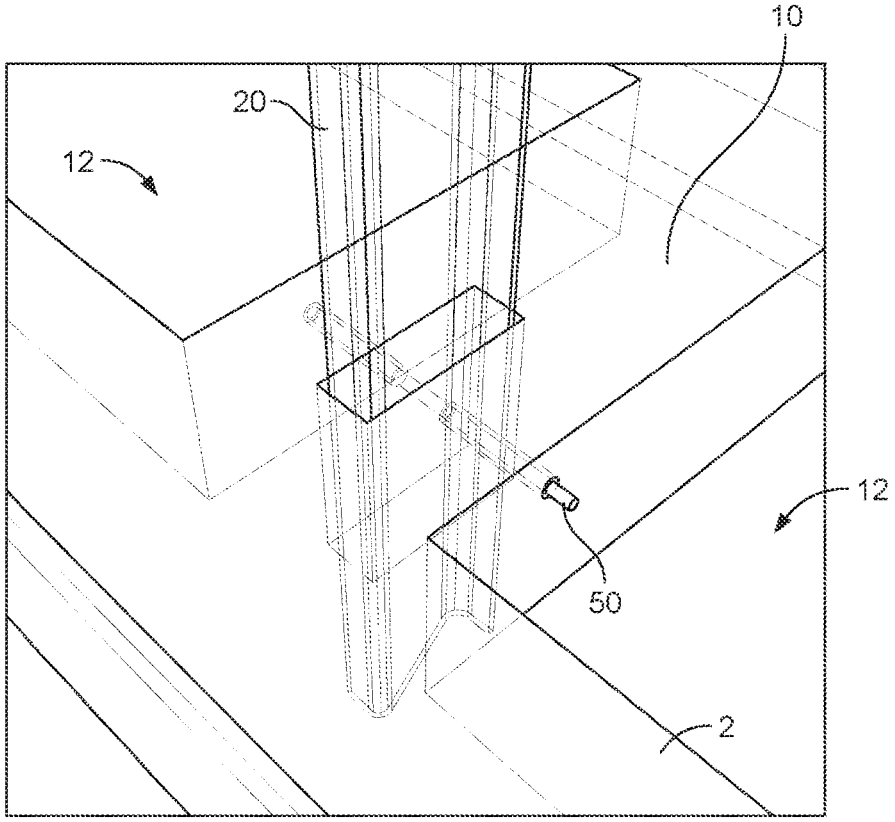
FIGS. 7A and 7B are perspective views of part of another embodiment of the invention.
Figure 7B:
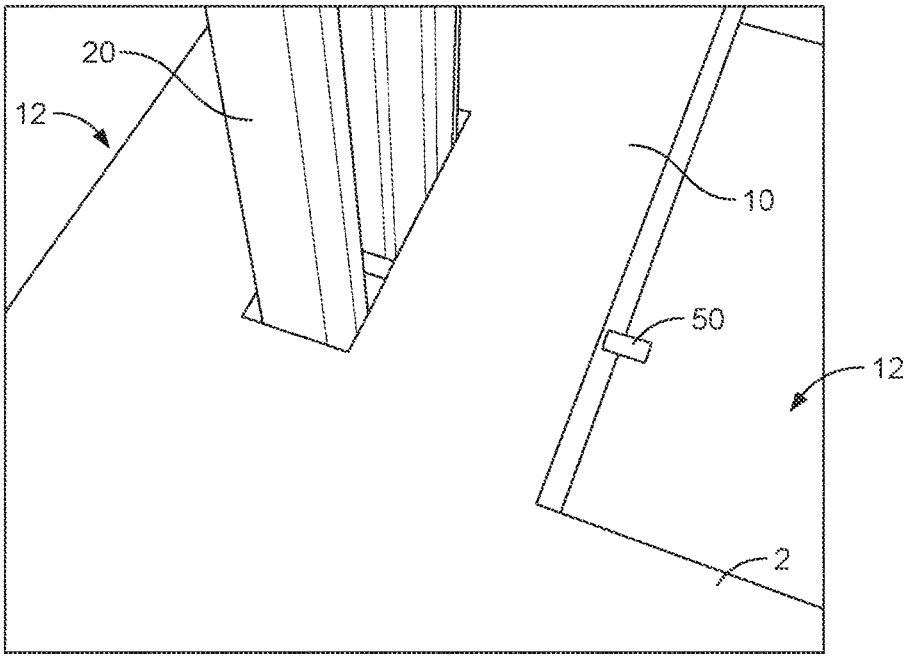

Referring to FIGS. 7A and 7B, the present example relates to an embodiment of the invention in which the support posts do not extend beneath the base unit. In such an embodiment, it is especially desirable that one or more sockets in the base unit are provided with retaining means for retaining a support post within the socket.

FIGS. 7A and 7B are perspective views of part of a base unit of such an embodiment, showing a support post in situ. FIG. 7A is shown semi-transparent, so that the positioning and operation of the retaining means can more readily be observed.

The embodiment illustrated in FIGS. 7A/B is generally similar to that shown in FIGS. 1-2 and like components are indicated with common reference numerals.

The base unit 2 comprises a plurality of sockets, each socket for receiving one end of a respective support post, and one such socket 8 is shown. The support post 20 is a conventional Z-section support post. The socket 8 is 175 mm deep and the base unit is 200 mm deep in total, such that the base unit extends a further 25 mm below the support post 20 when the support post is inserted into the socket 8.

As the support post 20 is not inserted into the ground beneath the base unit but only received within the base unit, it is desirable to provide additional retaining means to help retain the support post 20 in the base unit in the event of a vehicle impacting with the vehicle restraint system.

FIGS. 7A/B show one embodiment of such additional retaining means. The transverse rung 10 is formed with a circular bore which extends fully through the width of the rung 10 to the neighbouring aperture 12 on each side. The support post 20 is formed with a similarly-sized aperture therein which, when the post is fully inserted into the socket 8, is aligned with the bore through the rung 10. This alignment permits a steel retaining pin 50 to be inserted through the transverse rung 10, and the circular aperture in the support post 20. In the embodiment shown, the bore through the transverse rung 10, and the circular aperture in the support post 20, is 20 mm in diameter, and the retaining pin 50 is 12 mm in diameter. The retaining pin is of sufficient length that it projects a little way into each of the apertures 12 adjacent to the rung 10. Each end of the pin is screw-threaded to receive a nut to fasten the pin in place, although other fastening means could be employed.

Example 7

Figure 8:
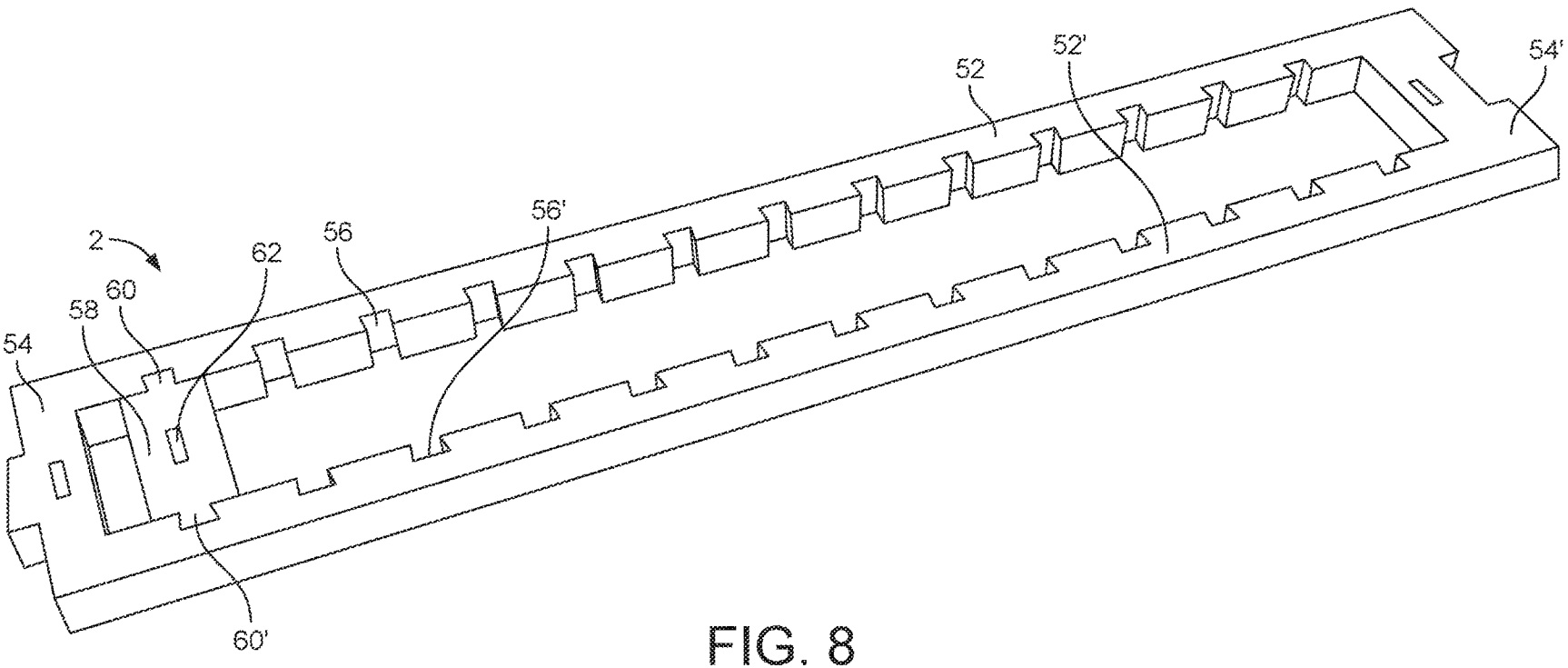
FIG. 8 is a perspective view of a further embodiment of a base unit of use in the present invention.

Yet another embodiment of the invention is illustrated in FIG. 8.

In the illustrated embodiment, a base unit 2 for use in a system in accordance with the fourth aspect of the invention is formed of reinforced concrete. Unlike the embodiments described in the preceding examples, the base unit does not have transverse rungs forming an integral part of the base unit. Rather, the transverse 'rungs' are provided by individual attachment units, which are separate, prefabricated, components of the system.

The base unit 2 takes the form of a rectangular frame, with a pair of substantially identical side members 52,52', (which are mirror images of one another), which are joined at their ends by a pair of substantially identical end members 54,54'.

The base unit 2 illustrated in FIG. 8 comprises 13 identical reception sites. Each reception site comprises a pair of dovetail-shaped recesses, one of each pair being provided in the opposed side members 52,52' of the base unit 2. In FIG. 8, a representative pair of recesses is indicated by reference numerals 56,56'.

In the illustrated embodiment, one of the reception sites in the base unit 2 is shown occupied by an individual attachment unit 58. The attachment unit has a main body which is of suitable dimension to be slidably received between the side members 52,52' of the base unit. The main body of the attachment unit 58 is formed with a pair of projections 60,60'. The projections 60,60' are of suitable size to be snugly received within a respective one of each pair of recesses, and are of a dovetail shape reciprocal to that of the recesses. Accordingly, the attachment unit 58 may be slidably inserted into the base unit 2 but, once located within the base unit, forms an interlocking frictional engagement therewith, so as to resist relative lateral movement.

It will be appreciated that, because the reception sites on the base unit are essentially identical, the attachment unit 58 could be received within any one of the reception sites provided on the base unit 2.

Further, in the illustrated embodiment, the attachment unit 58 is provided with a central socket 62 in the main body of the attachment unit, which socket 62 is adapted and configured to accommodate a conventional Z-section support post, on which a vehicle restraint barrier may be mounted. However, other embodiments can be envisaged in which, for example, the attachment unit is adapted and configured to receive a substantially conventional surface-mounted support post.

Typically, in use, three or four individual attachment units would be inserted into the base unit and normally would be located at regular spacings along the base unit. The individual attachment units can be introduced into the base unit after the base unit has been positioned at the desired location, or may be introduced into the base unit before it has been positioned.

Finally, it is noted that the end members 54,54' of the base unit are formed with reciprocal male and female dovetail projections, which allows co-operating engagement with the ends of corresponding base units 2 at the desired location, as described in Example 1 above.

Example 8

Figure 9A:
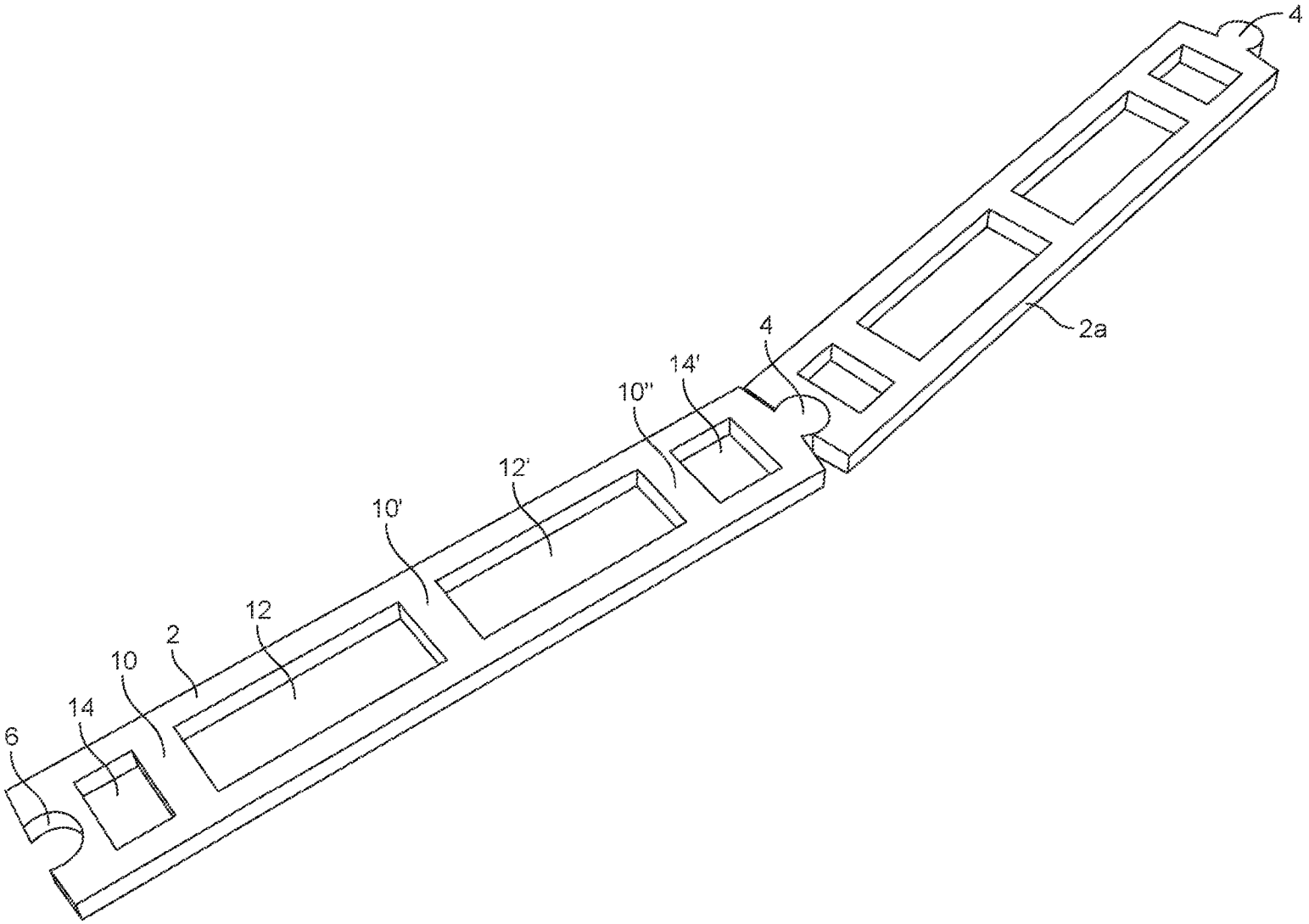
FIGS. 9A-9C are various views of yet another embodiment of a base unit in accordance with the present invention.
Figure 9B:
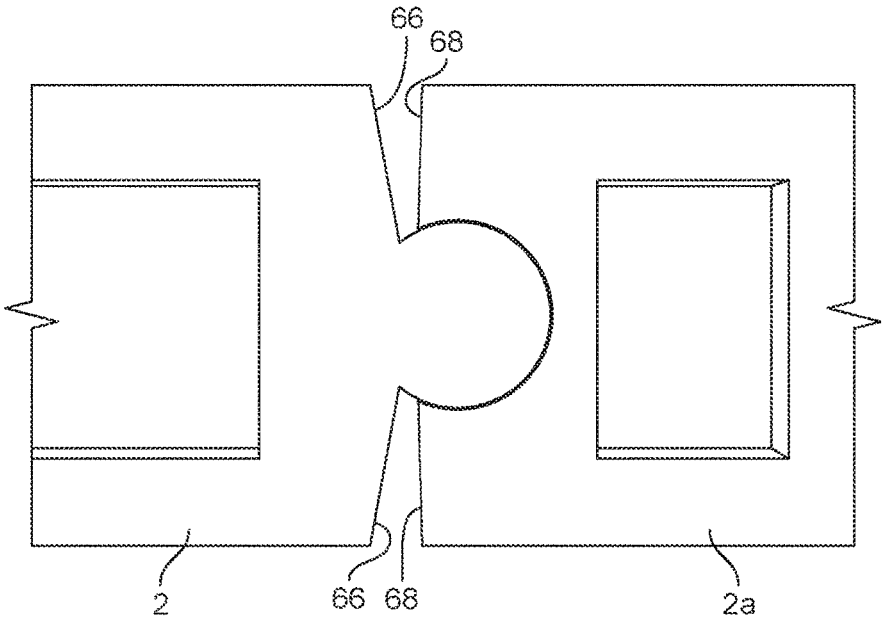
Figure 9C:
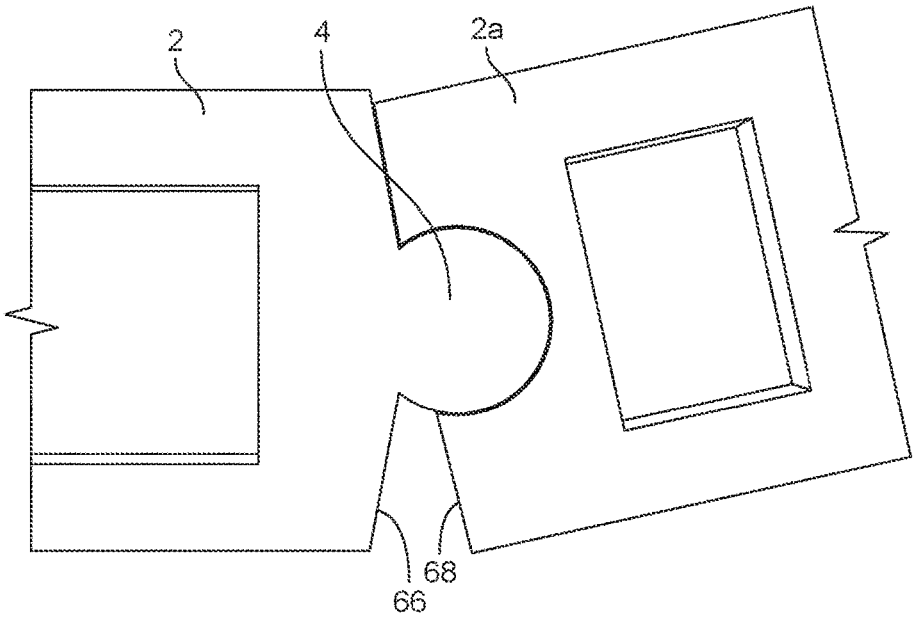

FIGS. 9A-9C are various views of a further embodiment of a base unit of use in a system/method in accordance with the invention.

FIG. 9A is a perspective view of a pair of base units which are in an interlocking engagement which allows for limited relative rotational or pivotal movement of the engaged adjacent base units. FIGS. 9B and 9C are plan views of the engaged portions of the base units, showing that the engagement allows for limited relative rotational or pivotal movement of the base units in a horizontal plane.

Where the features shown in FIGS. 9A-9C are generally equivalent or correspond to features shown in other drawings they are indicated with common reference numerals.

Referring to FIGS. 9A-9C, two identical base units 2, 2*a* have ends adapted and configured so as to allow for at least some relative rotational or pivotal movement in a horizontal plane. The base units 2, 2*a* are each provided with a projecting male member 4 which has a curved face describing about 260-270° of a circular arc. The male member 4 of base unit 2 is received within the reciprocally shaped female recess 6 formed on the end of base unit 2*a*. The interlocking engagement created by the insertion of male member 4 into the female recess 6 prevents engagement and disengagement of the base units 2, 2*a* by simple relative longitudinal movement. Instead, the base units 2, 2*a* are engaged or disengaged by relative vertical displacement.

As apparent from the Figures, the arrangement allows for some limited relative rotational or pivotal movement of the two base units 2, 2*a* in a horizontal plane. The angle of rotational movement permitted is increased by the presence of angled, sloping shoulder portions 66 either side of the male member 4 and, to a lesser extent, by the slightly angled sloping shoulder portions 68 either side of the female recess 6.

The invention claimed is:

1. Apparatus for installing a vehicle restraint at a desired location, the apparatus comprising a length of a pre-fabricated base unit locatable in or on a ground surface at the desired location, the base unit having a plurality of attachment positions at intervals, wherein each attachment position is configured to receive a respective substantially vertical support post for supporting the vehicle restraint, wherein the pre-fabricated base unit consists of or substantially comprises reinforced concrete, wherein the base unit comprises longitudinally opposed rail sections with transverse portions across the base unit, the traverse portions extending between the opposed rail sections and transverse to a length of the base unit, the attachment positions being located on each of the traverse portions, and the base unit comprises a plurality of apertures to facilitate access to services located beneath the base unit, the access to the services is for inspection, maintenance or repair of the services, and the plurality of apertures are provided between each pair of adjacent transverse portions, extend through the base unit from a top surface to a bottom surface of the base unit and are dimensioned to permit maintenance and repair of services, and wherein metal reinforcing components in the base unit do not extend into the plurality of apertures.

2. The apparatus according to claim 1, wherein at least one aperture of the plurality of apertures is provided between adjacent attachment positions of the plurality of attachment positions.

3. The apparatus according to claim 1, wherein each attachment position comprises a socket in or through the base unit, the socket being adapted and configured to accommodate one of the substantially vertical support posts.

4. The apparatus according to claim 1, wherein each attachment position in the base unit is adapted and configured to receive one of the substantially vertical support posts and comprises at least one integral metal anchor or fixing incorporated into the base unit before the concrete of the base unit has set, each vertical support post being securable to its respective integral metal anchor or fixing by means of a screw-threaded bolt.

5. The apparatus according to claim 1, wherein opposed ends of the base unit are shaped and dimensioned to co-operate with an end of a further base unit.

6. The apparatus according to claim 5, wherein one end of the opposed ends of the base unit is configured to form an interlocking engagement with the end of the further base unit.

7. The apparatus according to claim 5, wherein one end of the opposed ends of the base unit is formed with a male member and the other opposed end of the base unit is formed with a reciprocally-shaped female member.

8. The apparatus according to claim 5, wherein the opposed ends of the base unit are shaped and dimensioned so as to permit the base unit to be moved in a substantially vertical plane relative to the further base unit, but so as to resist lateral relative movement of the base unit and the further base unit in the substantially horizontal plane, optionally whilst allowing pivotal movement in a horizontal plane.

9. The apparatus according to claim 1, in combination with, or comprising, a pre-fabricated concrete conduit unit which provides a conduit for services beneath the base unit.

10. The apparatus according to claim 9, wherein the conduit unit additionally provides a drainage channel for draining water from the base unit and/or an adjacent carriageway, and co-operating profiles are provided on the base unit and the conduit unit to facilitate alignment thereof.

11. A system for installing a vehicle restraint at a desired location, the system comprising a pre-fabricated base unit in accordance with claim 1, in combination with at least one support post adapted and configured for attachment to the base unit at a selected one of the plurality of attachment positions provided on the base unit.

12. The system of claim 11, further comprising a crash barrier adapted and configured for attachment to the at least one support post.

13. A method of installing a vehicle restraint system, the method comprising the steps of:

(i) positioning a selected pre-fabricated base unit in accordance with claim 1 at a desired location; and (ii) anchoring at least one support post to the base unit.

14. The method of claim 13, further comprising the step of:

(iii) attaching a vehicle restraint or crash barrier to the anchored support post resulting from the performance of step (ii).

15. The method of claim 13, further comprising the preliminary step of excavating a trench of length and width suitable to accommodate the base unit.

16. The method of claim 15, wherein spoil from the excavation of the trench is used to backfill the excavated trench after the pre-fabricated base unit has been positioned in the trench.

17. A system for installing a vehicle restraint barrier at a desired location, the system comprising a length of the pre-fabricated base unit as defined in claim 1 locatable in the ground surface at the desired location, the base unit having a plurality of reception sites for receiving at least one individual attachment unit for attachment thereto of a substantially vertical support post for supporting the vehicle restraint barrier.

18. The system according to claim 17, comprising the base unit as aforesaid in combination with one or more individual attachment units.

19. The system according to claim 18, wherein the individual attachment units consist, or are substantially formed, of concrete or reinforced concrete.

20. The system according to claim 18, wherein the reception sites on the base unit are essentially identical, and the individual attachment units are essentially identical, such that any of the individual attachment units may be received at any of the reception sites.

21. A method of installing a vehicle restraint barrier at a desired location using a system in accordance with claim 17, the method comprising the steps of:

a) positioning a selected pre-fabricated base unit, of the system, at the desired location;

b) introducing one or more individual attachment units into a corresponding number of reception sites on the base unit; and c) attaching at least one support post to each of the one or more individual attachment units; and d) affixing a vehicle restraint barrier to the at least one support post;

wherein steps (a) and (b) may be performed in either order.

22. The apparatus according to claim 1, wherein each of the plurality of apertures have a rectangular shape.

* * * * *